United States Patent [19]

Wakahara et al.

[11] Patent Number: 5,029,462

[45] Date of Patent: Jul. 9, 1991

[54] METHOD OF BENDING A WORKPIECE INCLUDING SETTING A BENDING PROCESS, AND PREPARING BENDING DATA

[75] Inventors: Takashi Wakahara, Hadano; Tadahiko Nagasawa, Kanagawa; Takashi Onoue, Isehara, all of Japan

[73] Assignee: Amada Company, Limited, Japan

[21] Appl. No.: 389,798

[22] Filed: Aug. 4, 1989

[30] Foreign Application Priority Data

Aug. 5, 1988 [JP] Japan ..... 63-194452
Aug. 9, 1988 [JP] Japan ..... 63-197168

[51] Int. Cl.[5] ..... B21C 37/02; B21D 5/02
[52] U.S. Cl. ..... 72/379.2; 72/389
[58] Field of Search ..... 72/481, 389, 379.2, 72/363

[56] References Cited

FOREIGN PATENT DOCUMENTS 3442923 6/1986 Fed. Rep. of Germany ..... 72/389
0154230 6/1988 Japan ..... 72/481

*Primary Examiner*—David Jones
*Attorney, Agent, or Firm*—Wigman & Cohen

[57] ABSTRACT

A method for bending a workpiece into a developed shape between an upper and lower die. The method includes setting up a bending sequence for bending the workpiece from a unfinished to a finished state. The method is accomplished by preparing data for a workpiece shape, i.e. assigning bending points on the workpiece; determining consecutive striking points and bending points; determining preparatory bending points to avoid interference between the workpiece and dies; assigning identification codes for the preparatory bending points, and bending the workpiece.

4 Claims, 15 Drawing Sheets

FIG.7
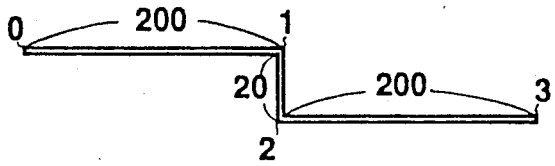
FIG.8
WORKPIECE SHAPE INPUT DATA
| BENDING POINT NUMBER | LENGTH | BENDING ANGLE |
|---|---|---|
| 1 | 200 | +90.00 |
| 2 | 20 | −90.00 |
| 3 | 200 | |
FIG.9
BENDING PROCESS INPUT DATA
| PROCESS NUMBER | STRIKE POINT | BENDING POINT | PREPARATORY BENDING ANGLE | |
|---|---|---|---|---|
| 1 | *0 | *1 | 130 | ← PREPARATORY BENDING |
| 2 | 3 | 2 | | |
| 3 | 0 | 1 | | ← ADDITIONAL BENDING |
FIG.10
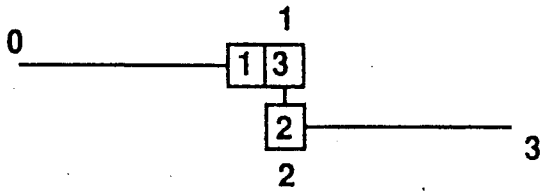

FIG.13 (a)
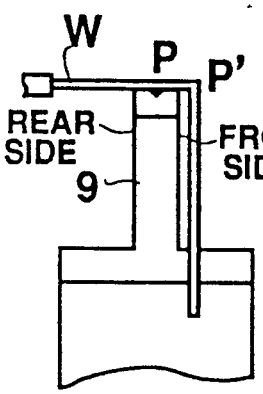
FIG.13 (b)
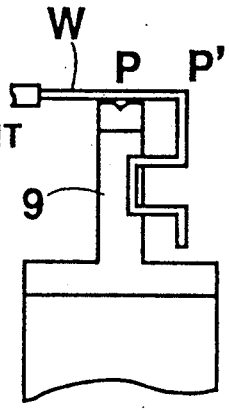
FIG.13 (c)
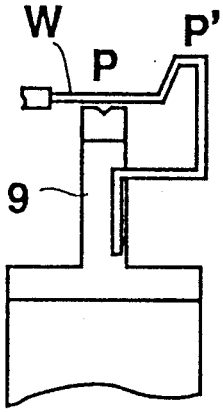
FIG.13 (d)
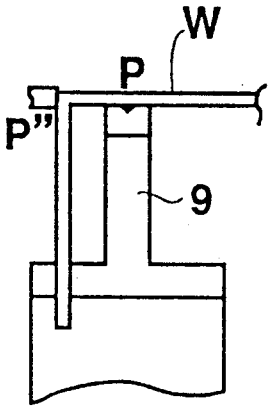
FIG.14
WORKPIECE SHAPE INPUT DATA
| BENDING POINT NUMBER | LENGTH | ANGLE |
|---|---|---|
| P' | XXX | − 90.00 |
| ⋮ | ⋮ | ⋮ |
| P | XXY | + 90.00 |
| ⋮ | ⋮ | ⋮ |
| P" | XXZ | − 90.00 |
| ⋮ | ⋮ | ⋮ |

FIG.15

BENDING PROCESS INPUT DATA

| PROCESS NUMBER | STRIKING POINT | BENDING POINT |
|---|---|---|
| x | Q | P' |
| y | S | P" |
| n | T | P |
| n+1 | U | R |

← INTERFERENCE CHECK

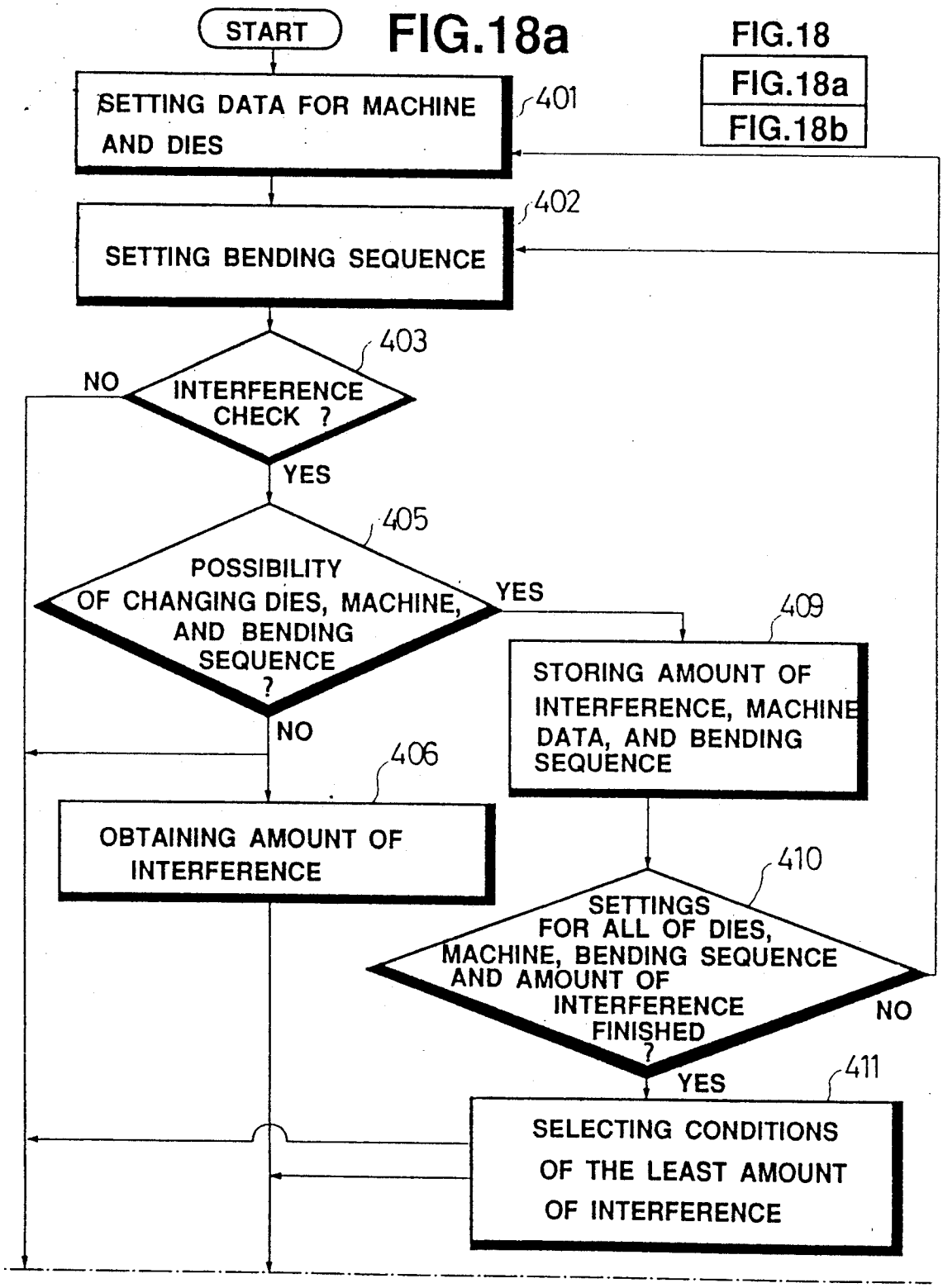
START
FIG.18a
FIG.18
FIG.18a
FIG.18b
SETTING DATA FOR MACHINE AND DIES
401
SETTING BENDING SEQUENCE
402
INTERFERENCE CHECK ?
403
NO
YES
POSSIBILITY OF CHANGING DIES, MACHINE, AND BENDING SEQUENCE ?
405
YES
NO
STORING AMOUNT OF INTERFERENCE, MACHINE DATA, AND BENDING SEQUENCE
409
OBTAINING AMOUNT OF INTERFERENCE
406
SETTINGS FOR ALL OF DIES, MACHINE, BENDING SEQUENCE AND AMOUNT OF INTERFERENCE FINISHED ?
410
NO
YES
SELECTING CONDITIONS OF THE LEAST AMOUNT OF INTERFERENCE
411

METHOD OF BENDING A WORKPIECE INCLUDING SETTING A BENDING PROCESS, AND PREPARING BENDING DATA

BACKGROUND OF THE INVENTION

1. Field of the Invention

The present invention relates to a method and a device for setting a bending process when a plate-shaped workpiece is bent by a bending machine such as a press brake or the like, and also to a method for preparing bending data.

2. Description of the Prior Art

Generally, in a bending machine such as a press brake or the like, when a workpiece W is subjected to a bending process, for example, when a product of a shape such as shown in FIG. 1 is obtained, first a 90° bending process is carried out at a bending point 2, then the workpiece W is rotated from top to bottom and the same 90° bending process is performed at a bending point 1.

However, with this type of bending process, when the bend at the bending point 2 has been completed and the workpiece W is set on a lower die D to make the bend at the bending point 1, as shown by a solid line in FIG. 2(*a*), the workpiece W interferes with the lower die D and a situation is created wherein it becomes impossible to set the workpiece W on the specified position on the lower die D.

Accordingly, as shown in FIG. 2(*b*), in order to perform bending process in which the 90° bend is performed at bending point 1 after the same is done at bending point 2, it is necessary to use the so-called "preparatory bending process" to avoid interference with the lower die D. In the preparatory bending process, bending is preliminarily carried out to a shallow bending angle at the bending point 1, and after the bending process at the bending point 2, bending is again performed at the bending point 1, and a true 90° angle is obtained at the bending point 1.

In the abovementioned "preparatory bending process" the workpiece W is not processed to the final angle at the bending point in one step. The first part of the process is an obtuse angle bend; the second part is a final bend to obtain the required object angle.

FIG. 3 shows the abovementioned preparatory-bending process. As shown in FIG. 3 (*a*), one end O of the workpiece W is impacted by a striking member C of the bending machine, and the preparatory bend is performed at a shallow bending angle at the bending point 1. Next, as shown in FIG. 3 (*b*), the workpiece W is rotated and the bending is completed to produce a true 90° angle at bending point 2. Following this, as shown in FIG. 3 (*c*), additional bending is again performed at the bending point 1 to reach a 90° angle, which is the final objective bending angle.

However, with a conventional bending machine, there is no known method of setting the process in which this type of preparatory bending can be performed automatically. In addition, there is no known device which will automatically check for interference between the lower die and the workpiece in an NC device for a bending machine, or which will, in the case where there is concern that such interference will be produced, automatically set the preparatory bending process and set the process to avoid interference between the die and the workpiece.

In recent years, in the field of bending processing, which still must resort to manual operation, a process has been developed by which bending data has been prepared semi-automatically: while the actual bending status is being simulated for set bending dies, bending data for determining the amount of movement of the back gauge of the bending machine and the dies for the set bending dies and bending sequence, can be drawn up semi-automatically.

Conventionally, in the method of drawing up this bending data, when there is interference between the workpiece and the mold, this condition is displayed on the simulation screen to advise the operator.

Therefore, conventionally, the operator changes the bending sequence or the dies based on the data indicating that interference exists. The question as to whether new dies should be fabricated is decided from the criterion of the amount of interference; after the interfering portion of the dies is suitably removed to avoid the interference, once again an interference check is made. In most case, it is possible to eliminate this interference by changing the bending sequence or changing the dies, but, to prevent adverse effects on the shape of the product and the precision of the bend, there are occasions when it is impossible to change the bending sequence or the dies.

However, in the method of drawing up bending data in the abovementioned conventional manner, in the case where there is interference between the workpiece and the dies, there is only a report indicating that interference exists; therefore, when an additional process is to be performed at the dies in order to eliminate the interfering portion of the dies to avoid subsequent interference between the workpiece and the dies, the operator must prepare the data for the additional processing to take off part of the dies, based on this information. The problem exists that a great deal of time and trouble is necessary to prepare this data for this additional process.

In addition, when there is interference between the mold and the workpiece, the process of drawing up the bending data is halted at this point so that after the additional processing on the die, the bending data must therefore be revised and prepared again.

SUMMARY OF THE INVENTION

A first object of the present invention is to provide, with due consideration to the drawbacks of such conventional devices, a method of setting up the bending process so that it is possible to automatically perform preparatory bending on the bending machine.

The first object of the present invention is achieved by the provision of a method of setting up the bending process, comprising the steps of preparing data for a workpiece shape, the data including numbers assigned to a series of bending point, starting from one side of the developed shape of the workpiece and bending length and bending angle for each of the bending points; determining consecutive striking points and bending points in the process sequence by using workpiece shape data prepared above; determining bending points where the preparatory bending is needed; and assigning identification codes and shallow bending angles for the preparatory bendings to the bending points determined above.

A second object of the present invention is to provide a process setting up device which can automatically check for interference from the input of the shape of the workpiece and the details of the process; and when there is concern that interference may be produced, the device can automatically set up the preparatory bending.

The second object of the present invention is achieved by the provision of a setting up device comprising a bending process setting means; an interference checking means which simulates the bending process for the workpiece based on the input from the bending process setting up means and checks for interference between the workpiece and the upper on lower dies; and a preparatory bending setting means which, when the interference checking means has determined that interference will be produced when performing the bending operation at specific bending points, detects the bending points at which preparatory bending is required to avoid interference at the above-mentioned specific bending points, and automatically sets a preparatory bending identification code and a bending angle for the bending process instructions to those bending points.

A third object of the present invention is to provide a method of preparing data by which it is possible to automatically prepare data for additional processing of the die when there is interference between the workpiece and the mold, and then continuing the procedures for preparing the bending data.

The third object of the present invention is achieved by the provision of a method of preparing bending data for turning the workpiece into a product, comprising the steps of: checking for interference between the workpiece and the dies; if interference is detected, preparing data for additional processing of the dies corresponding to the amount of interference; and continuing to prepare the bending data assuming that the die is additionally processed.

BRIEF DESCRIPTION OF THE DRAWINGS

These and other objects, features, and advantages of the present invention will become more apparent from the following description of the preferred embodiments taken in conjunction with the accompanying drawings, in which:

FIG. 2 (*b*) is an explanatory drawing showing a preparatory bending process for a workpiece to avoid the creation of interference.

FIG. 7 is a sectional drawing showing the shape of the workpiece obtained in this embodiment.

FIG. 8 is an explanatory drawing of a table for the workpiece shape input data required to obtain this shape in the workpiece.

FIG. 9 is an explanatory drawing of a table for the necessary process input data for obtaining this shape in the workpiece.

FIG. 10 is a drawing of a display example showing the bending process sequence to obtain this shape in the workpiece.

FIG. 13 (*a*) to (*d*) are explanatory drawings showing an interference pattern of the workpiece in this embodiment of the present invention.

FIG. 14 is an explanatory drawing of a table for input shaping data for this embodiment of the present invention.

FIG. 15 is an explanatory drawing of a table for input process data for this embodiment of the present invention.

FIGS. 18*a* and 18*b* show a process flow chart for a method for preparing bending data.

DETAILED DESCRIPTION OF THE PREFERRED EMBODIMENTS

Figure 4:
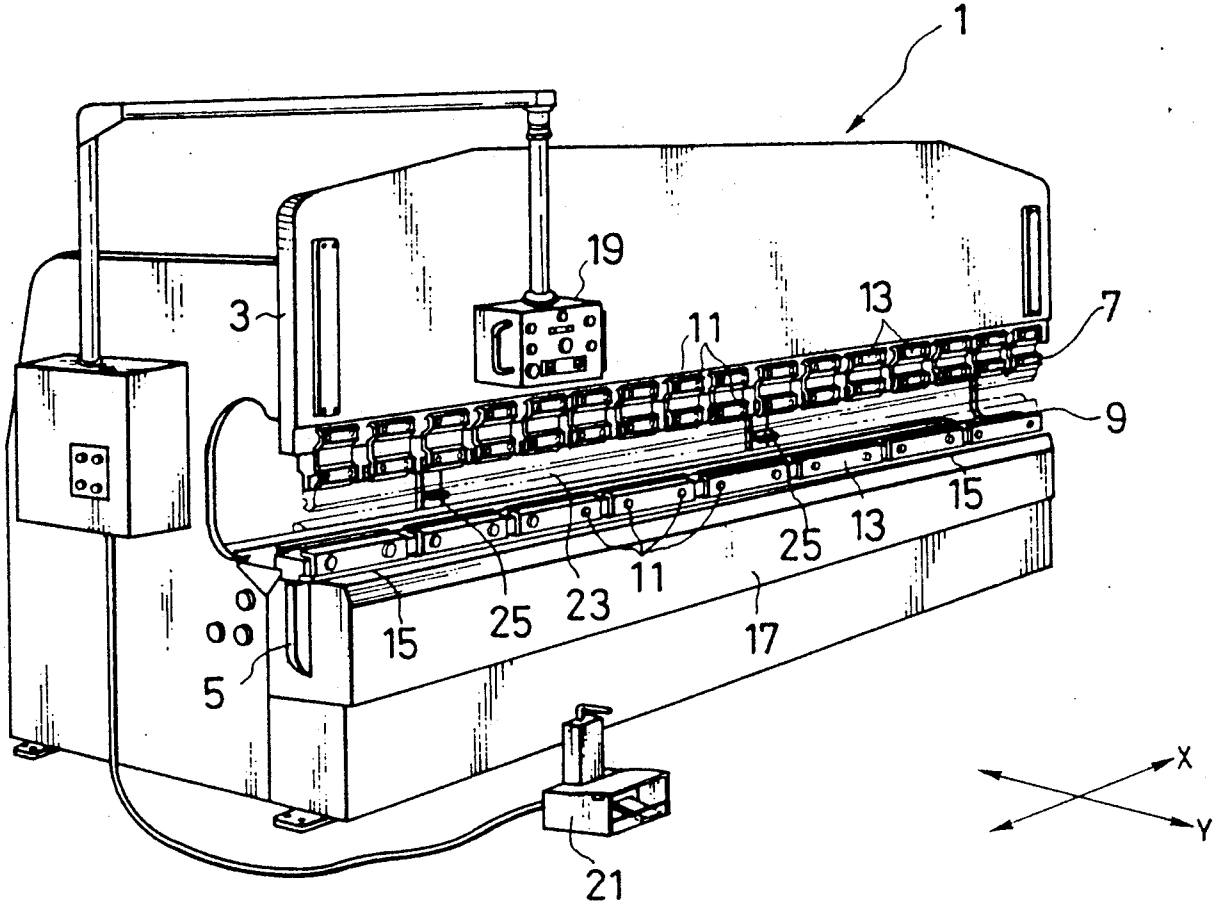
FIG. 4 is a perspective drawing of a bending machine which utilizes one embodiment of the present invention.

Now referring to FIG. 4, a press brake is shown as a bending machine 1 which comprises an upper apron 3 and a vertically operating lower apron 5. A punch 7 on the lower section of the upper apron 3 and a die 9 on the upper section of the lower apron 5 are respectively secured by a plurality of bolts 11 through a dies clamping member 13. To do this, with the bolts 11 in a loosened state the punch 7 and the die 9 are inserted through the upper apron 3 or the lower apron 5 from, for example, the right direction, and the bolts 11 are secured by one again tightening them when in a suitable position. A front cover 17 equipped with a tool post 15 extending in the lateral direction (in the X axis direction) is provided on the front surface of the lower apron 5.

A movable-type operating panel 19 and a movable-type foot pedal device 21 are used to provide elevating instructions to the lower apron 5. In addition, the input for the necessary data for an NC device can be performed by using the operating panel 19.

Figure 5:
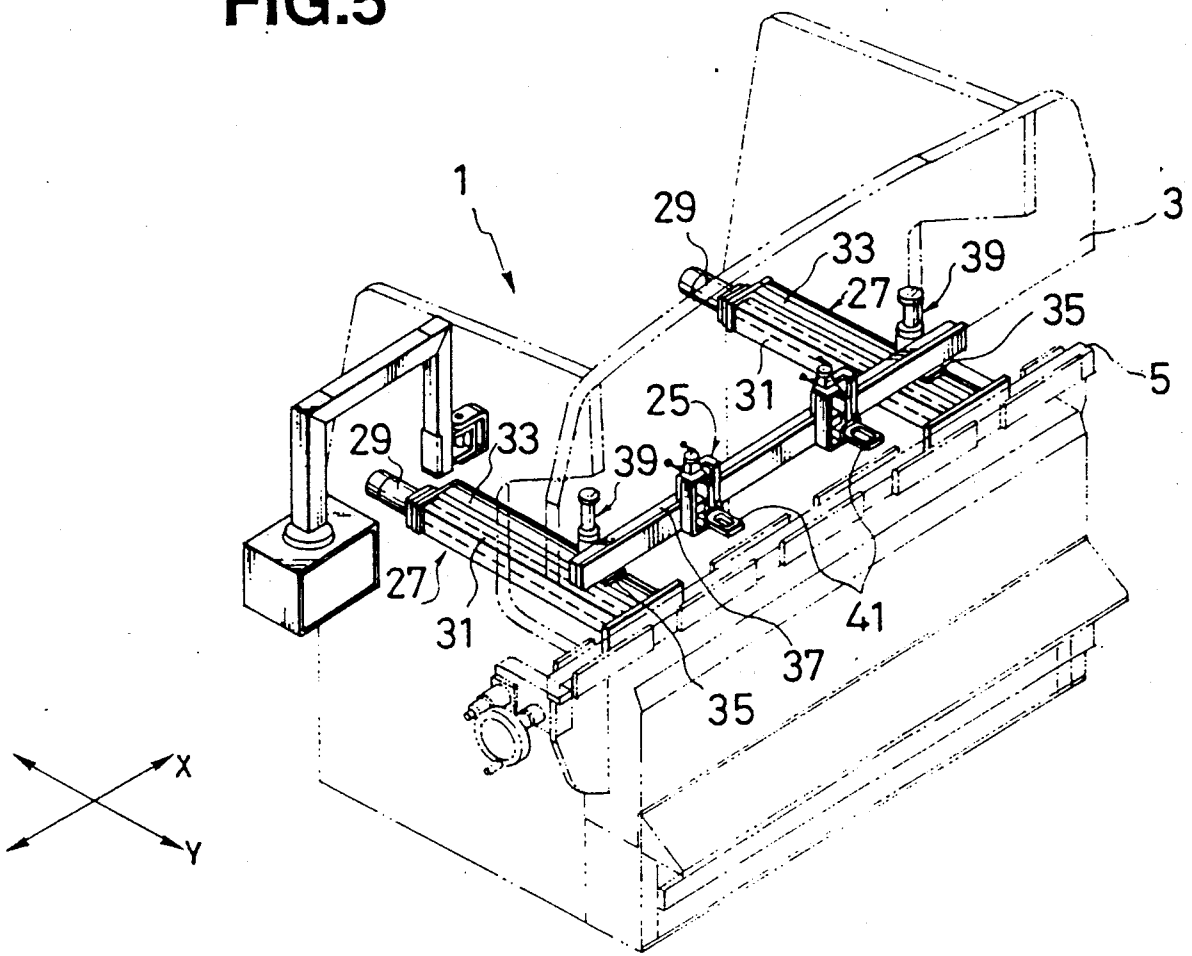
FIG. 5 is a perspective drawing of a back gauge device used on the bending machine.

As shown in detail in FIG. 5, a back gauge 25 is provided in a workpiece processing space section 23 between the upper apron 3 and the lower apron 5 of the bending machine 1. The back gauge 25 is provided with a plurality of support bodies 27 which project in the rear direction (in the Y axis direction) in the vicinity of the left and right ends of the lower apron 5. A lead screw 31 which is driven by a motor 29 and a linear motion guide 33 which runs parallel to the lead screw 31 are provided on the support bodies 27.

A pair of movable stands 35 are provided on the lead screw 31 and the linear motion guide 33. A beam 37 for which the height is freely adjustable by means of an elevating drive device 39 extends horizontally over the distance between the right and left lateral movable stands 35, 35.

The back gauge 25 is mounted in a freely lateral positionable manner with respect to the beam 37, and a striking member 41 is provided on the front of the back gauge 25. The height of the striking member 41 can be adjusted by means of the elevating drive device 39 of the movable stands 35.

In bending a workpiece W by means of the bending machine 1, first the workpiece W is inserted into the workpiece processing space section 23 of the bending machine 1, then the tip of the workpiece W is struck by the tip surface of the striking member 41 on the back gauge to which the gauging has been made. Next, the lower apron 5 is elevated with respect to the upper apron 3, and a bending process is performed on the workpiece W between the punch 7 and the die 9. This series of operations is performed automatically by the NC device.

Figure 6:
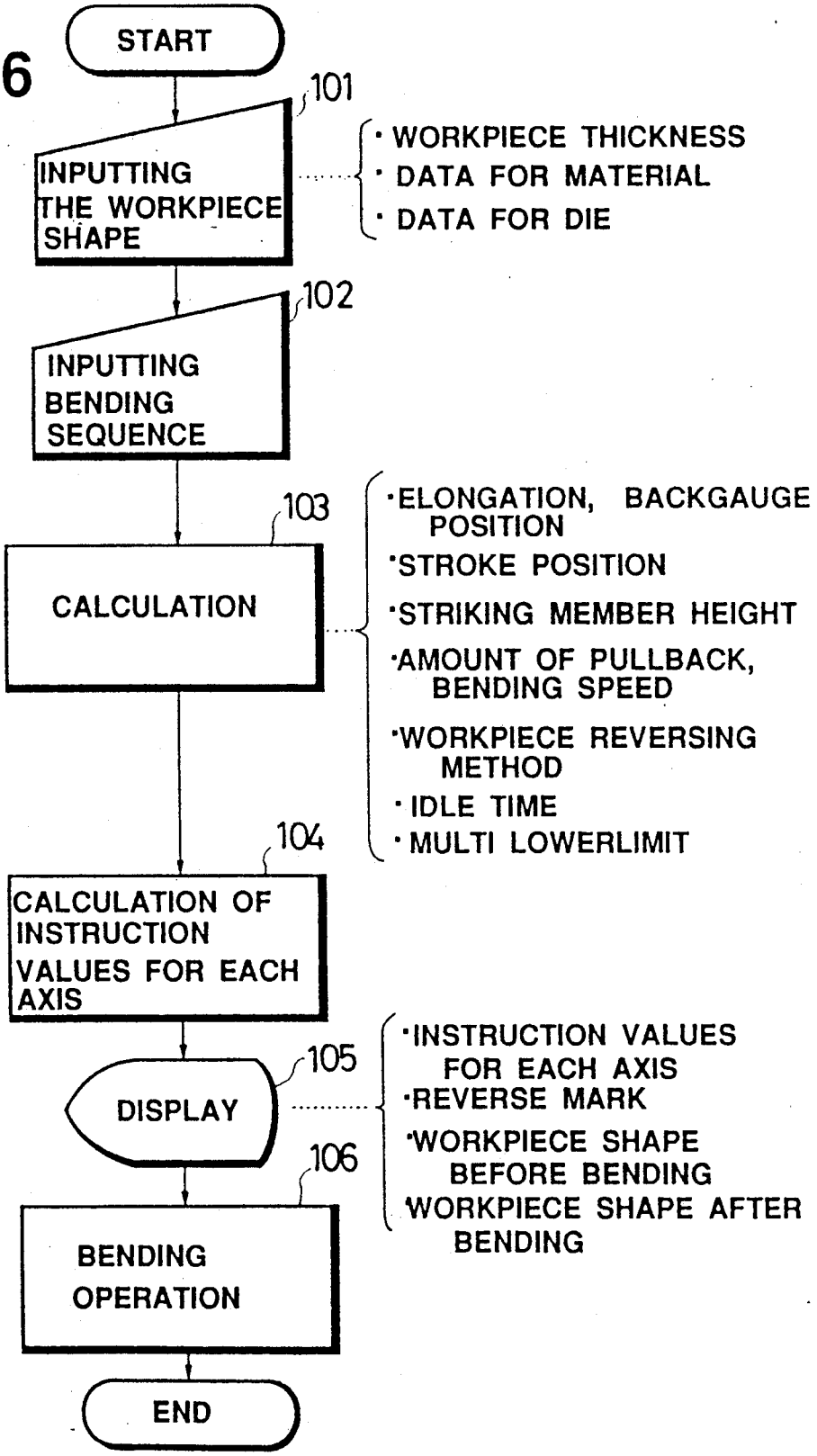
FIG. 6 is an explanatory flow chart for one embodiment of the present invention.

FIG. 6 is a flow chart showing one embodiment of the method which sets the process for bending the workpiece W of the specified shape by means of the bending machine 1.

When a product is bent into the shape shown in FIG. 7, it is necessary to provide shaping input to the NC device for the workpiece W.

To do this, in a step 101, data about the material, and plate thickness of the workpiece W and about the dies is input, the numbers 0, 1, 2, . . . , . . . , are assigned to each of a plurality of consecutive bending points from one end of the workpiece W as indicated in FIG. 8, and the bending length and bending angle are input for the respective bending points.

From the shape input data format shown in FIG. 8, it is seen that a bend of 90 deg is to be made at the bending point 1 and a bend of 90 deg in the opposite direction at the bending point 2.

After the shape input data is input to that effect, in a step 102, processing data is input in the format shown in FIG. 9.

From this bending process input, it is seen that point 0 is the strike point for the striking member 41 in the first bending process, and bending point 1 is the position on which the lower die is set. In the second bending process, it is seen that the workpiece W is struck at point 3 by the striking member 41, and point 2 is set as a bending point.

Also, in the process input, because preparatory bending is required at the process point 1 in the case of this embodiment, when input 0, which shows that the striking member 41 strikes at the strike point 0, is provided, it is assigned a preparatory bend classification code, such as "*(star code)", is input as a code which can specify the preparatory bending and the preparatory bend angle is input.

After that, the data for the normal bending process 2 is input, and after this normal bending process, additional bending process data is input to cause the additional bending at the bending point 1 in the third process step.

When this type of workpiece shape input and bending process input is completed, in a step 103, calculations for the workpiece extension corresponding to the workpiece product shape, the position corresponding to the workpiece product shape, the position of the back gauge 25, the elevating stroke position for the lower apron 5, the vertical position of the striking member 41, and the amount of pullback of the striking member 41 to retreat backward when a bending operation is performed, bending speed, method of reversing the workpiece W, and the like are calculated at the NC device side, according to the calculation program.

Calculations are made for the instruction values for each axis which controls the bending machine 1 (Step 104).

The results of the calculations are displayed (Step 105).

Figure 1:
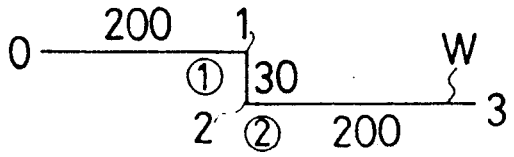
FIG. 1 is an explanatory drawing showing a conventional work bending process.
Figure 2:
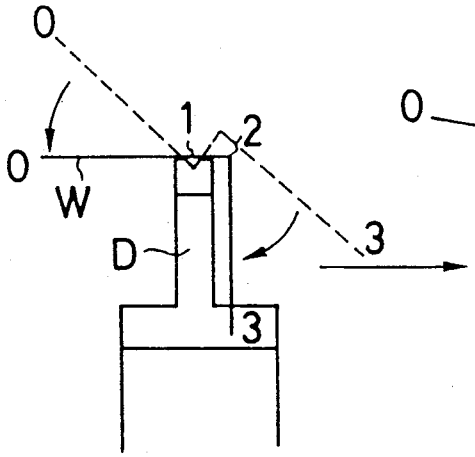
FIG. 2 (*a*) is an explanatory drawing showing a condition where interference of the workpiece is created.
Figure 2:
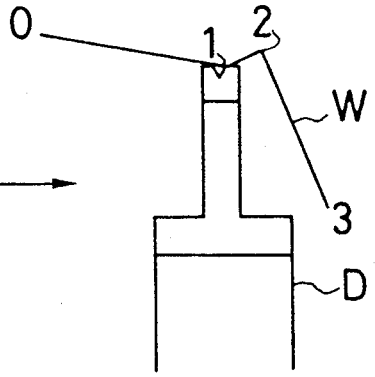
Figure 3:
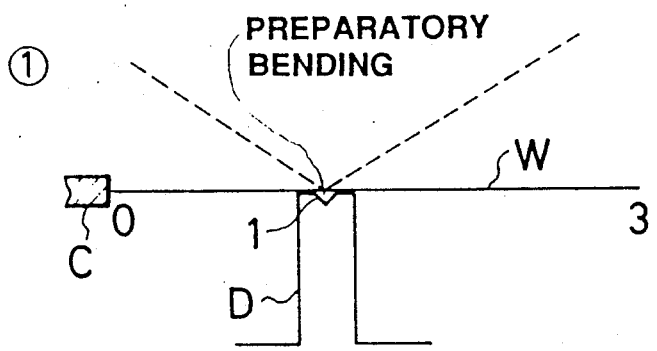
FIG. 3 (*a*) to (*c*) are explanatory drawings explaining the preparatory bending process
Figure 3:
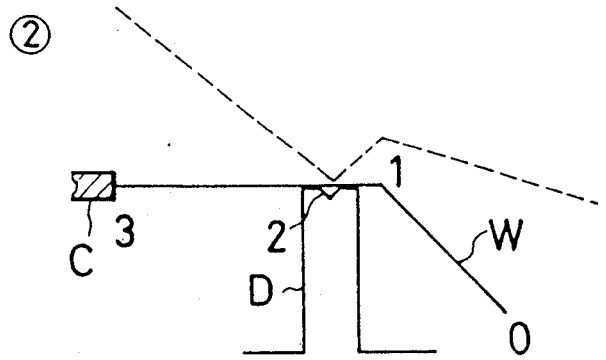
Figure 3:
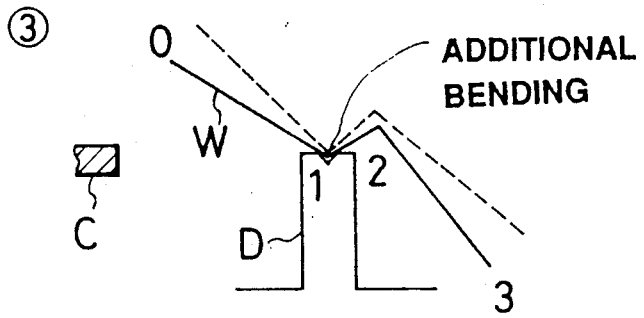

In the display in Step 105, the process shown in FIG. 3 (*a*) to (*c*) is displayed, and "Preparatory bend" and additional bend are also displayed for the preparatory bend process and the additional bending process respectively at the same time on the process diagram.

In addition, until the additional bending which follows the preparatory bending, the preparatory bending angle for the bending point 1 where the preparatory bending took place, is displayed as the workpiece W shape.

Then, after the additional processing, the display shows the shape where the true bending angle is produced.

This completes the input of the input data for the shape of the workpiece and the bending process sequence. After the operator confirms the correctness of this input data from the display of the bending process, the data is input for the bending operation (Step 106).

In this way, using the process setting method for the bending machine of this embodiment of the present invention, by inputting the preparatory process data for the shape of workpiece W and for the bending process sequence from the keyboard or other input means, it is possible to set the preparatory bending process and obtain a screen display of the preparatory bending process, so that the operator can check the preparatory bending process from the screen display at the NC device.

Figure 11:
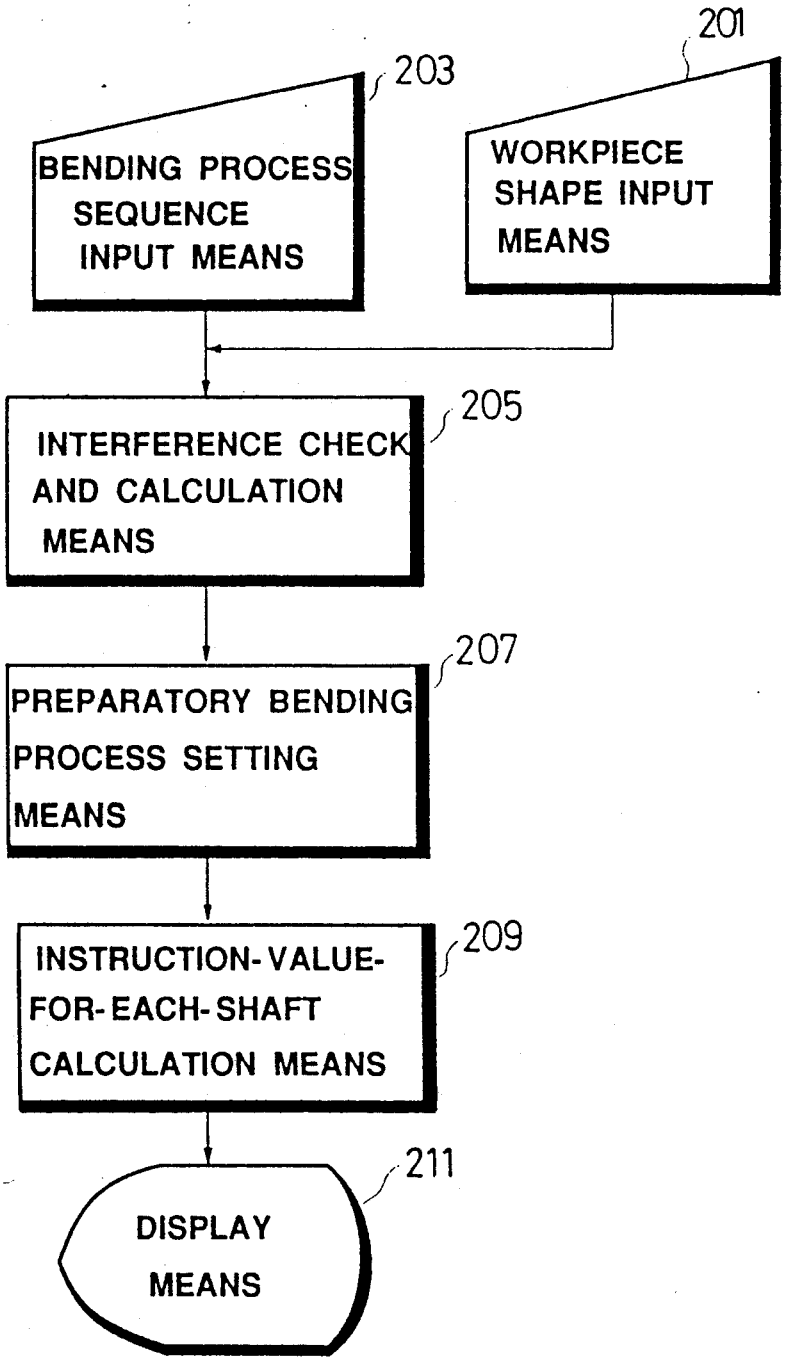
FIG. 11 is a block diagram for one embodiment of the process setting device of the present invention.

FIG. 11 shows the process setting device of the bending machine of the present invention which comprises: a workpiece shape input means 201 and a bending process sequence input means 203 which may be normal keyboards and which input data from which the bending process is simulated; an interference check means 205 which checks for interference; a preparatory bending process setting means 207, which sets a new preparatory bending process and revises the bending process when the interference check means 205 finds interference; an instruction-value-for-each-shaft calculation means 209 which calculates the instruction value for each axis according to the complete bending process set by the preparatory bending process setting means 207; and a display means 211 which displays the bending process based on the results of the calculations from the instruction-value-for-each-shaft calculation means 209, displays the preparatory bending process, and displays the input data, and the like.

By means of the process setting device of the bending machine, as shown in FIG. 13 (*a*) to (*c*), when the bending process is about to be carried out at a specific bending point P, if there is concern that the side of workpiece W in front of the bending point P will interfere with the lower die 9, a bending point P′ is found which is the closest to the bending point P on the front side and which has a bending angle opposite in direction to the specific bending point P, and the preparatory bending process is set automatically for the bending point P′.

In addition, as shown in FIG. 13(*d*), when the bending process is carried out at the specific bending point P and interference is found at the side to the rear of the lower die 9 and the bending point P, a bending point P″ is found which is the closest to the bending point P on the rear side and which has a bending angle opposite in direction to the specific bending point P, and the preparatory bending process is set for the bending point P″.

Figure 12:
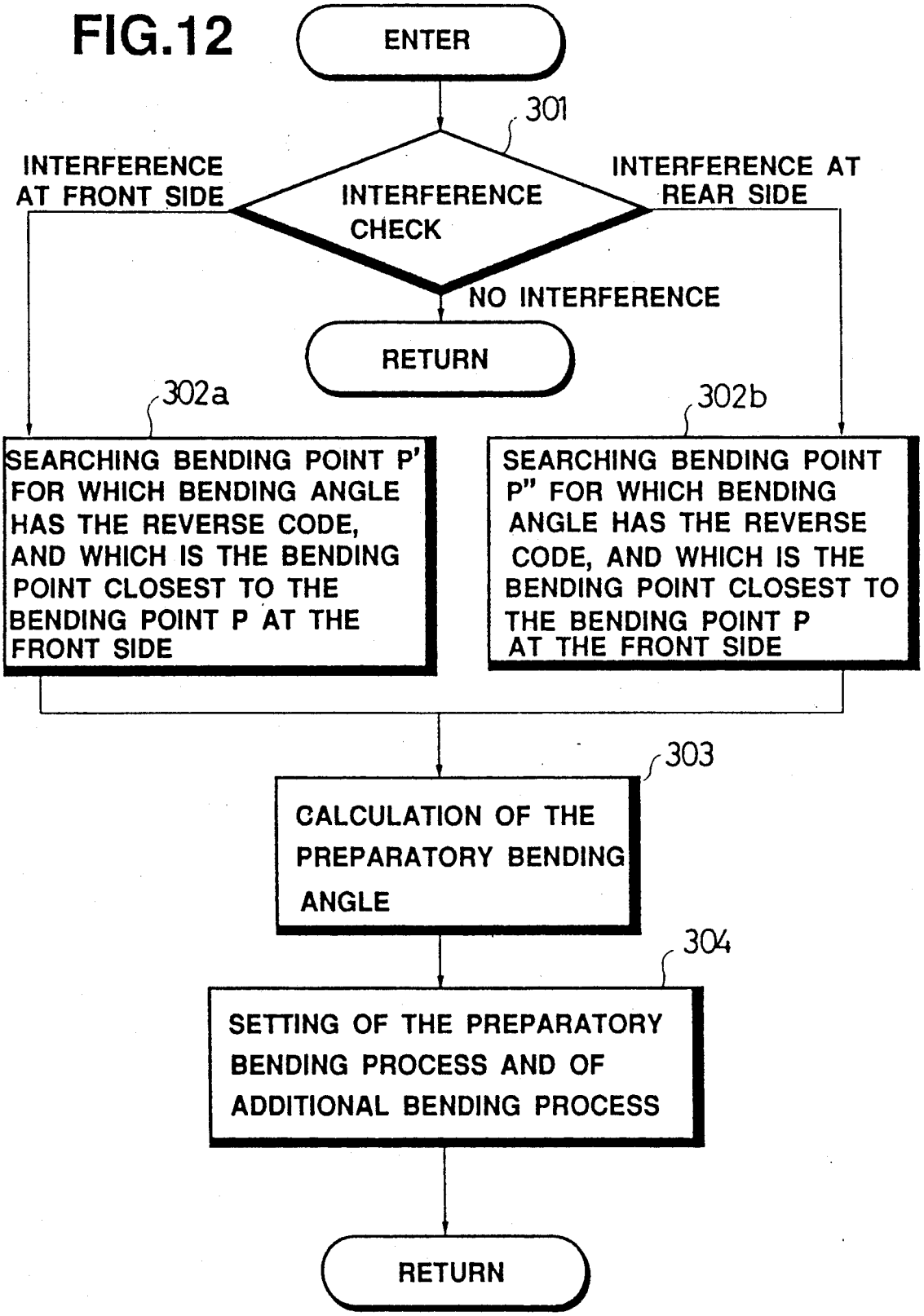
FIG. 12 is a flow chart explaining the actions of this embodiment of the present invention.

In short, in the case where shape input data is provided from the input means 201, as shown in FIG. 14, and normal bending process input data from the input means 203 as shown in FIG. 15, the interference check means 205 and the preparatory bending process setting means 207 perform the interference check and the preparatory bending process setting action in accordance with the flowchart shown in FIG. 12.

When the simulation of the bending process is performed by the interference check means 205 based on the process input data, on finding that interference with the bottom die at the bending point P of the bending process number n has occurred, the decision is made as to whether interference has been produced in front or to the rear of the lower die 9 (Step 301).

Then, when the interference is produced in front, a bending point is found for which the bending angle has the reverse code to the bending point P, and which is the bending point closest to the front with respect to the bending point P for which interference has been produced, in short, a bending point P' is found and the preparatory bending process is set automatically at a bending process number x with respect to the bending point P' (Steps 302*a*, 303, 304).

Figure 16:
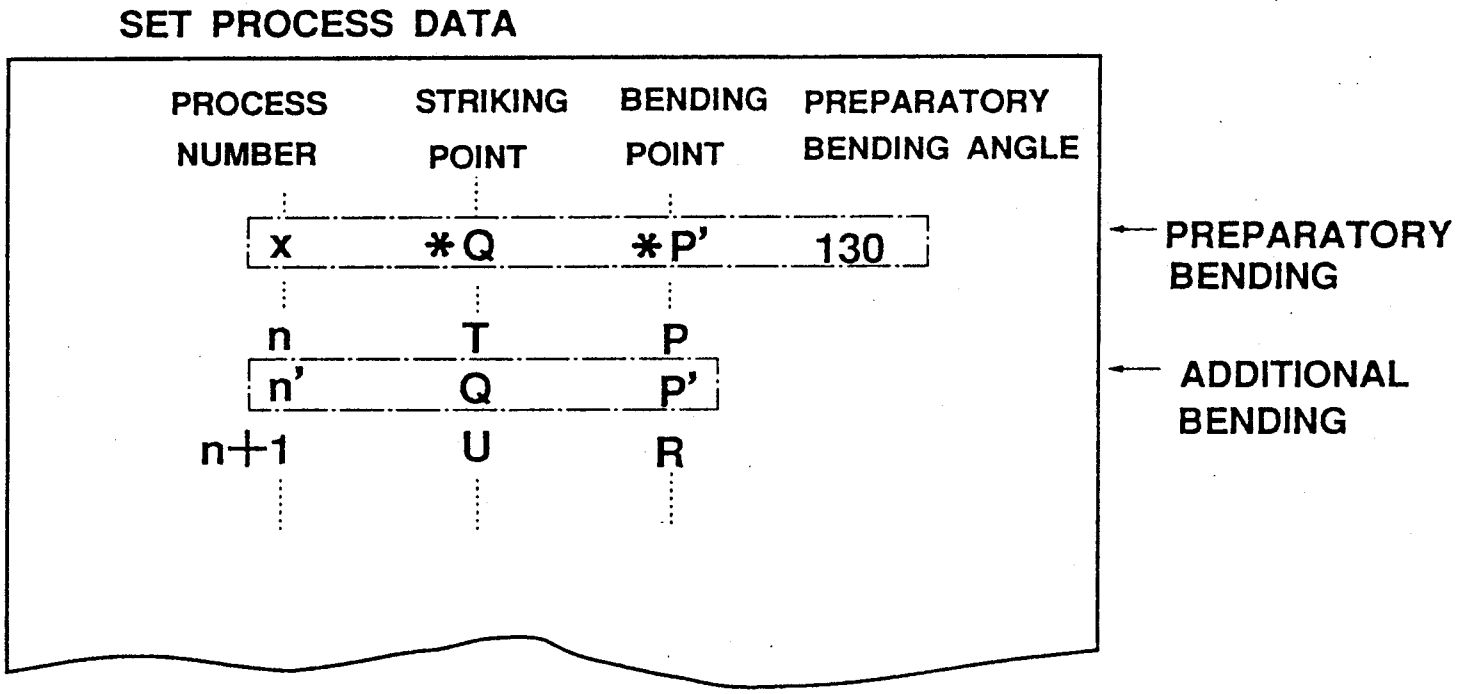
FIG. 16 (*a*) and (*b*) are explanatory drawings for a data table showing an example of setting a preparatory bending process in this embodiment of the present invention.
Figure 16:
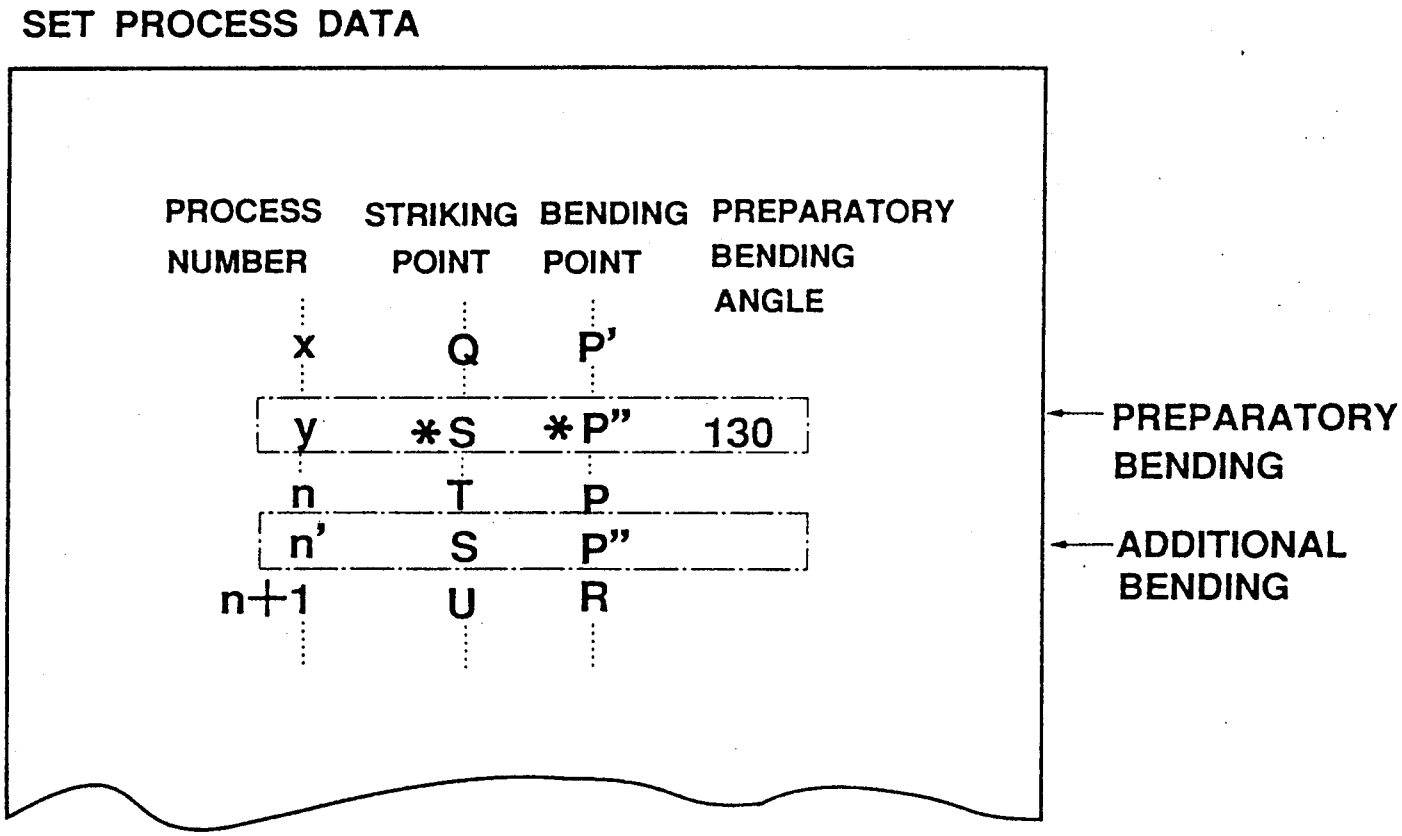

In short, as shown in FIG. 16 (*a*), the preparatory bending identification symbol "*" is displayed at the bending process number x of the bending point P', and at the same time, the preparatory bending angle is also set, and an additional bending process n' is added at the bending point P', following the bending process n of the specific bending point P.

In addition, if it is found in Step 301 that interference is produced at the rear of the specific bending point P, a bending point P'' is selected which is the closest to the bending point P on the rear side and which has a bending angle opposite in direction to the specific bending point P (Step 302*b*).

Then, as shown in FIG. 16 (*b*), the "*" symbol is attached to set the preparatory bending process for the bending process y of the bending point p''. At the same time the preparatory bending angle is set, and an additional bending process n' is also added at the bending point P'', following the bending process n of the specific bending point P. The preparatory bending process is then automatically set (Steps 303, 304).

In this way, by entering input data for a workpiece shape and bending process, a check is made for interference by the NC device. If it is found that interference is produced at a specific bending point, the preparatory bending process is automatically set for a point produced before that bending point so that no interference is produced.

When this is done, the preparatory bending process is automatically set, after which each bending process which includes the preparatory bending process is displayed on the display means 211. At the same time, the preparatory bending process and the additional bending process display screens display "Preparatory bend" and "additional-bend", respectively, and this is checked by the operator.

Further, after setting the bending process for the workpiece W, the operator checks the operation on the display screen. Then the actual bending process is performed from the operating panel 19 or by operating the foot pedal device 21. Then, when the bending process at each point is completed, the back gauge 25 automatically performs gauging, following instructions from the NC device. The longitudinal and vertical positions of the striking member 41 are set, and the upper limit position of the lower apron 5 is also automatically set so that the sequential bending actions are implemented according to the bending process which was set.

As outlined above, when the bending process at a specific bending point takes place utilizing the process setting method for the bending machine of the present invention, if there is any concern that interference will occur between the workpiece and the lower die, it is possible to prevent such interference by setting the process for the preparatory bending process at the required bending points, making it possible to smoothly perform the bending operation for a plurality of shapes.

In addition, using the process setting device for the bending machine of the present invention, if data is input for the shape of the workpiece and for a normal bending process, if generation of interference occurs at a specific bending point, the NC device automatically checks for that interference, making it possible to automatically set the preparatory bending process at the required point so that the interference does not occur. This eliminates the troublesome task of carefully checking for interference and inputting the setting for the bending process on the part of the operator, thus reducing the burden at each step.

However, the above explanation covers the case where there is interference between the workpiece and the lower die, but there can also be interference between the workpiece and the upper punch, depending on the shape of the workpiece being bent. Accordingly, it is necessary to check for interference between the punch and the workpiece.

Figure 17:
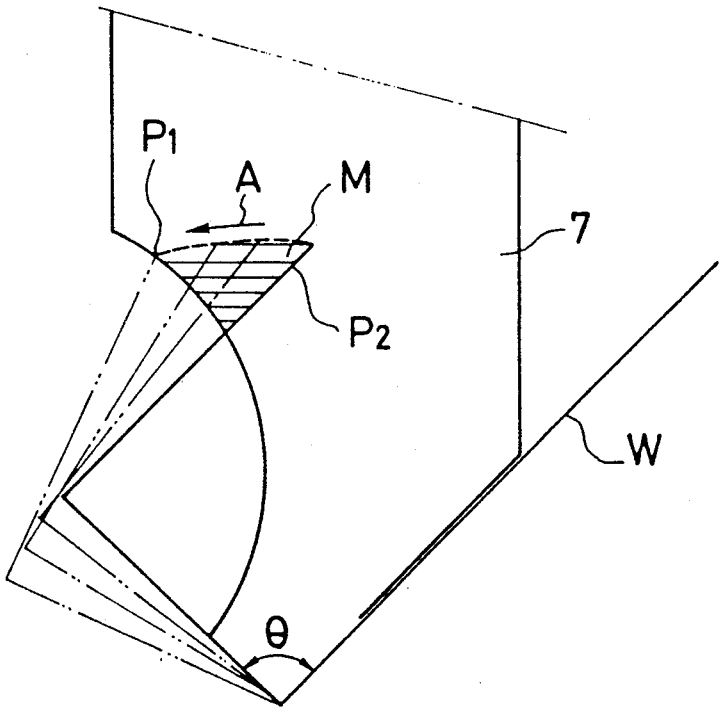
FIG. 17 is an explanatory drawing of an interference check.

As shown in FIG. 17, a check is made to see whether or not there will be interference between the punch 7 and the workpiece W when the workpiece W is bent by the punch 7.

From the example shown in the drawing, it is seen that an interference region M, indicated by the slanting lines, is created, with the interference running from the interference starting point $P_1$ at one end of the workpiece W to the point $P_2$ at which bending has been completed. Also, because the bending sequence is the reverse of the product development sequence, the interference region M is produced from the final bending point $P_2$, which is stipulated by the bending angle $\theta$, toward the point $P_1$ where the interference commences, as indicated by the arrow A.

Figure 18B:
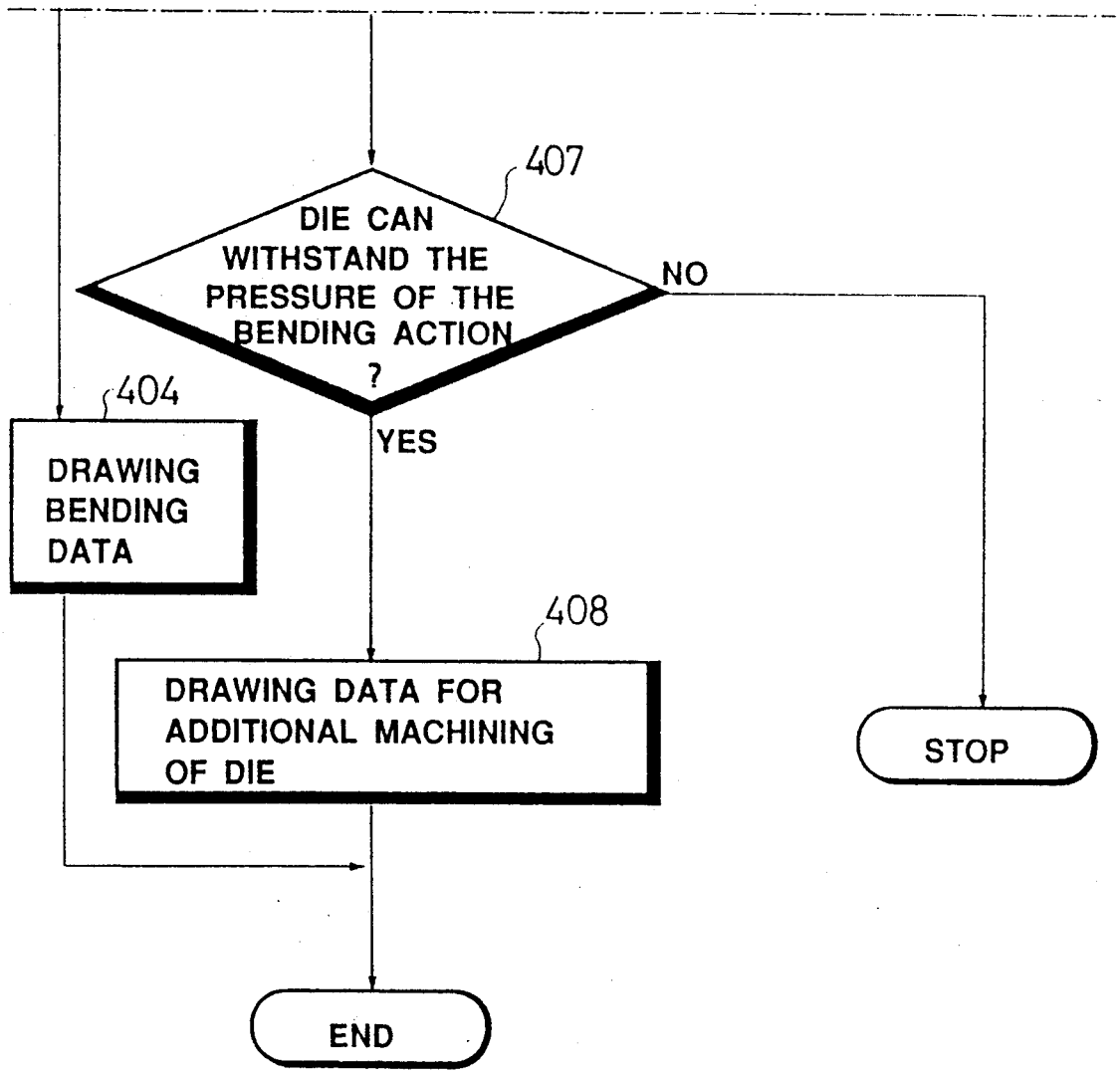

FIG. 18 shows that after the data for machine and dies are automatically or manually set in Step 401 and the bending sequence is automatically or manually set in Step 402, an interference check is implemented in Step 403, as shown in FIG. 17.

Accordingly, when, in Step 403, it is determined that the entire bending process is free from interference, the program moves to Step 404 where the bending data is drawn up for each process to be implemented.

On the other hand, when, in Step 403, it is determined that interference is present, the program moves to Step 405 where the decision is made as to whether or not it is possible to change the dies, machine, and bending sequence. The situations where the bending sequence cannot be changed are such as follows: various conditions about the dies or the like are fixed in relation to the precision of the product, or all possible conditions about the dies or the like have been checked.

When it is determined in Step 405 that a condition change is impossible, the decision in Step 403, indicating that interference is present, is ignored, the bending data is drawn up in Step 404, and at the same time the amount of interference is obtained in Step 406.

Next, in the case where the interfering section of the die has been removed to avoid interference between the workpiece and the die, a calculation and a decision is made to determine whether or not the processed die can withstand the pressure of the bending process.

In Step 407, if the decision is YES, data is drawn up for an additional process to remove the interfering part of the die in Step 408. If, in Step 407, the decision is NO, the bending of the workpiece is impossible so the program is halted.

When a condition change is possible in Step 405 the program moves to Step 409 where the current conditions for the dies, machine, bending sequence, and amount of interference are stored in memory.

In Step 410, it is determined whether or not the changes to the dies, machine, bending sequence, and amount of interference have been completed. If they are not yet completed the program returns to Steps 401 and 402 and once again an interference check is made under the changed conditions.

If in Step 410 the decision is YES, the program proceeds to Step 411 where conditions which give the least amount of interference in Step 409 are selected, then the program returns to Steps 404 and 407.

As can be understood from the foregoing explanation, the operator can obtain bending data from Step 404 when there is no interference, and can obtain bending data and data for the additional processing of the dies from Steps 404 and 408 when interference is present.

If this additional processing is carried out to the die, the interference detected in step 403 is eliminated. Then, the bending data prepared in Step 404 can be applied, without revision, for the additionally processed die.

If the data for the additional processing is provided as CAD data then it is possible to output NC data for the additional processing.

As seen above from this example, it is possible to obtain data for the additional processing of the dies when interference is present, and bending data concerning the dies which have been subjected to additional processing, based on the abovementioned data. Therefore, additional processing of the dies can be quickly carried out and it becomes unnecessary to spend additional time and trouble to once again prepare bending data.

As outlined above, in the present invention, when the bending data is prepared, if there is interference between the dies and the workpiece, both data for additional processing of the dies and bending data can be obtained. Therefore, the additional processing of the dies can be easily performed, and after this additional processing is completed the bending process can be quickly commenced.

Although the invention has been described in its preferred embodiments, it is to be understood that various changes and modifications may be made within the purview of the appended claims without departing from the true scope and spirit of the invention in its broader aspects.

What is claimed is:

1. A method of bending a workpiece into a developed shape between an upper die and a lower die including a method of setting up a bending process sequence for bending the workpiece comprising the steps of:

preparing data for a workpiece shape, the data including numbers assigned to a series of bending points, starting from one side of the developed shape of the workpiece, and said data further including a bending length and a bending angle for each of the bending points;

determining consecutive striking points and bending points in the process sequence by using the said prepared workpiece shape data;

determining bending points where a preparatory bending is needed to avoid interference between the workpiece and one of the dies during the process sequence;

assigning identification codes and shallow bending angles for the preparatory bendings to the bending points determined above; and bending the workpiece according to the said bending process sequence.

2. The method of claim 1, wherein the preparatory bending points determining step includes the sub-steps of:

simulating the bending process for the workpiece based on the data from the consecutive striking points and bending points determining step;

checking for an interference between the workpiece and at least one of the upper or lower dies; and when an interference is detected, determining preparatory bending points at which the preparatory bending is required to avoid the interference.

3. A method of bending a workpiece between an upper die and a lower die which are processed for bending in a bending machine according to a bending sequence, including a method of preparing bending data comprising the steps of:

checking for interference between the workpiece and the dies; and when an interference is detected, preparing data for an additional processing of at least one of the dies corresponding to the amount of interference;

processing said at least one of the dies in accordance with said data prepared when an interference is detected;

preparing the bending data assuming that the die has been additionally processed; and bending the workpiece in accordance with the prepared bending data, preparing data for a workpiece shape, the data including numbers assigned to a series of bending points, starting from one side of the developed shape of the workpiece, and said data further including a bending length and a bending angle for each of the bending points;

determining consecutive striking points and bending points in the process sequence by using the said prepared workpiece shape data;

determining bending points where a preparatory bending is needed to avoid interference between the workpiece and one of the dies during the process sequence;

assigning identification codes and shallow bending angles for the preparatory bendings to the bending points determined above; and bending the workpiece according to the said bending process sequence.

4. The method of claim 3, further comprising the step of selecting the best bending condition, where the amount of interference is minimum, among a plurality of bending conditions, wherein the bending condition is determined by data for the die to be used and the bending sequence.

* * * * *

UNITED STATES PATENT AND TRADEMARK OFFICE

CERTIFICATE OF CORRECTION

PATENT NO. : 5,029,462

DATED : July 9, 1991

INVENTOR(S) : Takashi WAKAHARA et al

It is certified that error appears in the above-identified patent and that said Letters Patent is hereby corrected as shown below:

Column 10:

Claim 3 line 42, "data," should be --data.--;

lines 43 through 60 should be deleted.

Signed and Sealed this

Twenty-ninth Day of September, 1992

*Attest:*

DOUGLAS B. COMER

*Attesting Officer*

*Acting Commissioner of Patents and Trademarks*